United States Patent [19]

Mullally et al.

[11] Patent Number: 4,509,340

[45] Date of Patent: Apr. 9, 1985

[54] ACCUMULATOR-DEHYDRATOR ASSEMBLY FOR AN AIR CONDITIONING SYSTEM

[75] Inventors: Charles J. Mullally, Muskegon; Steven L. Brown, Spring Lake; David L. Anderson, Muskegon, all of Mich.; Robert F. Hitchcock, Glendale Heights, Ill.

[73] Assignee: Sealed Power Corporation, Muskegon, Mich.

[21] Appl. No.: 551,101

[22] Filed: Nov. 10, 1983

[51] Int. Cl.[3] ..... F25B 43/00

[52] U.S. Cl. ..... 62/503; 55/183; 55/189; 62/474; 210/DIG. 6

[58] Field of Search ..... 62/503, 474, 475; 210/DIG. 6; 55/189, 190, 183

[56] References Cited

U.S. PATENT DOCUMENTS

| | | | |
|---|---|---|---|
| 3,084,523 | 4/1963 | Bottum et al. | 62/296 |
| 3,759,062 | 9/1973 | Wrenn et al. | 62/474 |
| 3,798,921 | 3/1974 | Scherer et al. | 62/217 |
| 3,824,802 | 7/1974 | Scherer et al. | 62/217 |
| 3,858,407 | 1/1975 | Schumacher | 62/503 |
| 4,111,005 | 9/1978 | Livesay | 62/503 |
| 4,270,934 | 6/1981 | Widdowson et al. | 62/503 |
| 4,291,548 | 9/1981 | Livesay | 62/503 |
| 4,331,001 | 5/1982 | Jones | 62/503 |

*Primary Examiner*—Ronald C. Capossela

*Attorney, Agent, or Firm*—Barnes, Kisselle, Raisch, Choate, Whittemore & Hulbert

[57] ABSTRACT

An accumulator-dehydrator assembly for an air conditioning system comprising an accumulator housing defining an enclosed chamber including an inlet and an outlet in the upper end and a refrigerant and oil accumulator in the lower end, and a vapor drier canister assembly comprising a one-piece plastic body defining a closed top wall, a closed side wall and an open bottom. The canister includes an integral outlet projecting into and sealingly engaging the outlet of the housing. A vapor filter is associated with the outlet of the canister such that refrigerant flows through the filter before passing through the outlet. A perforated plate is provided in the bottom of the canister for holding desiccant within the canister. A refrigerant and oil tube is mounted externally of the canister and has a lower end extending to the bottom of the chamber of the accumulator housing and has an upper end extending into the outlet of the canister. A filter is associated with the lower end of the tube.

62 Claims, 13 Drawing Figures

ACCUMULATOR-DEHYDRATOR ASSEMBLY FOR AN AIR CONDITIONING SYSTEM

This invention relates to air conditioning systems and particularly to air conditioning systems for automobiles and the like.

BACKGROUND AND SUMMARY OF THE INVENTION

With the increased use of air conditioners in automobiles, it has been found that system failures may occur because of the circulation of moisture in the refrigerant that adversely affects all components of the system but is especially damaging to the close tolerance components of the compressor. As a result increased repair costs and maintenance may be required.

Such air conditioning compressors are designed to operate on gaseous refrigerant only and include an accumulator that receives liquid and gaseous refrigerant from the evaporator and separates the liquid and gaseous refrigerant allowing only the gaseous refrigerant to enter the compressor. One way that has been used to remove moisture is to provide desiccant in cloth bags in the liquid refrigerant in the accumulator to adsorb moisture from the liquid. Although such a method is simple and inexpensive, it does not efficiently remove moisture since the desiccant adsorbs much less moisture from liquid than the vaporized refrigerant and there is no assurance that the gaseous refrigerant entering the compressor has come into contact with the desiccant.

In U.S. Pat. No. 4,331,001, it has been proposed to hold the desiccant above the liquid level in the accumulator housing and expose all of the vapors entering the compressor to the desiccant to remove any moisture. Although such a system is effective in removing moisture, it involves many parts requiring difficult assembly.

Accordingly, among the objectives of the present invention are to provide an accumulator-dehydrator assembly which is effective to remove the moisture, utilizes a minimum number of parts, is easy to assemble, utilizes low cost materials, and is easy to fill with dessicant.

In accordance with the invention, the accumulator-dehydrator assembly for an air conditioning system comprises an accumulator housing defining an enclosed chamber including an inlet and an outlet in the upper end and a refrigerant and oil accumulator in the lower end and a vapor drier canister assembly comprising a one-piece plastic body defining a closed top wall, a closed side wall and an open bottom. The canister includes an integral outlet projecting into and sealingly engaging the outlet of the housing.

A vapor filter is associated with the outlet of the canister such that refrigerant flows through the filter before passing through the outlet. A perforated plate with a felt pad is provided in the bottom of the canister for holding desiccant within said canister. A refrigerant and oil tube is mounted externally of the canister and has a lower end extending to the bottom of the chamber of the accumulator housing and has an upper end extending into the outlet of the canister. A plastic filter is associated with the lower end of the tube. Spring means yieldingly urges the perforated bottom plate upwardly. The canister has a desiccant filling opening in the side wall thereof, and interengaging means between the bottom plate and the canister for holding said bottom plate in a position such that desiccant can be introduced into the canister after which the bottom plate is released to hold the desiccant in the canister.

DESCRIPTION

Figure 1:
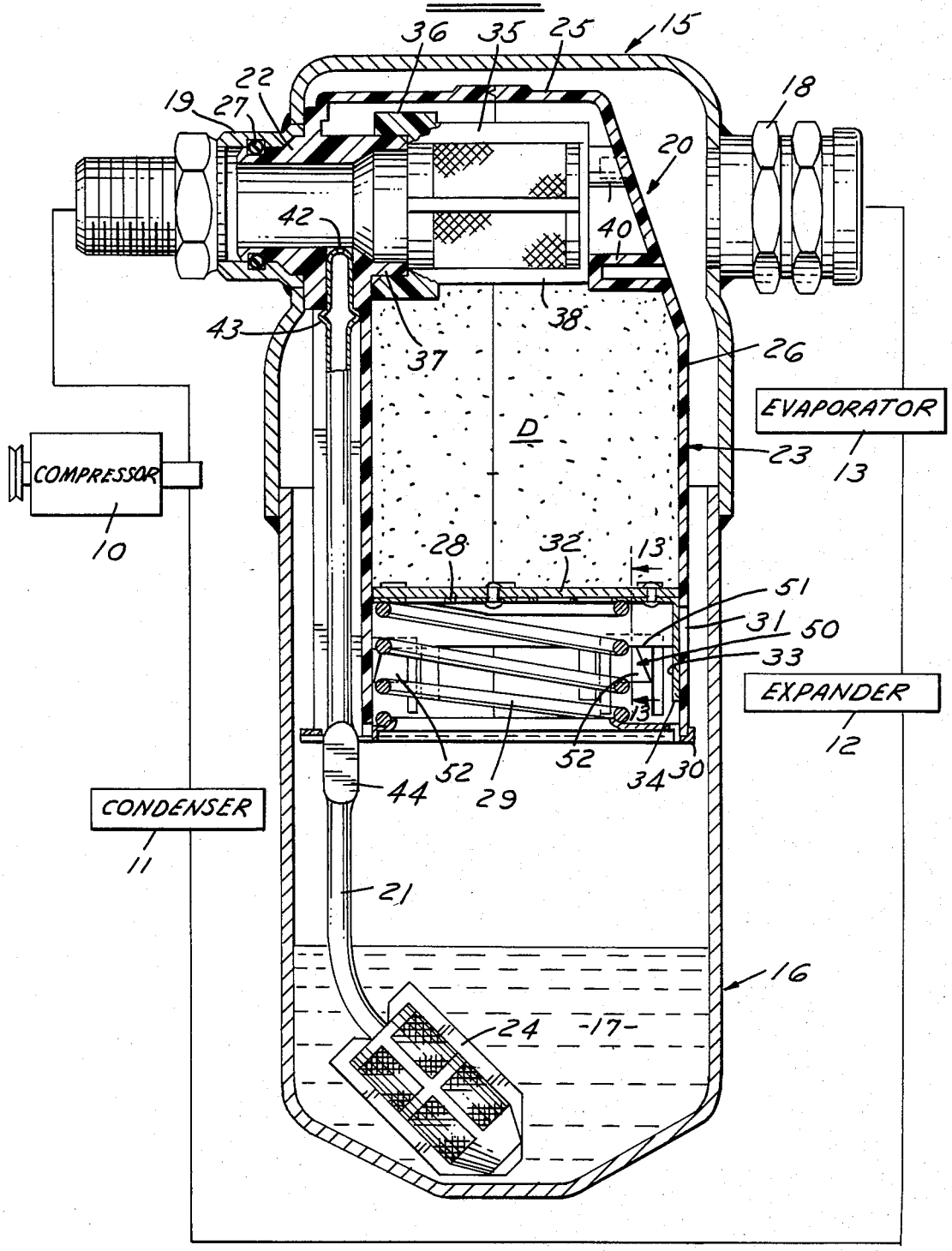
FIG. 1 is a part sectional partly diagrammatic view of an air conditioning system embodying the invention.

Referring to FIG. 1, an air conditioning system is shown schematically and comprises a compressor 10 which delivers refrigerant to a condenser 11 and, in turn, to an expander 12 and an evaporator 13 back to the compressor 10. The accumulator-dehydrator assembly 15 embodying the invention is provided between the evaporator 13 and compressor 10 and functions to remove the moisture from the gaseous refrigerant.

Figure 2:
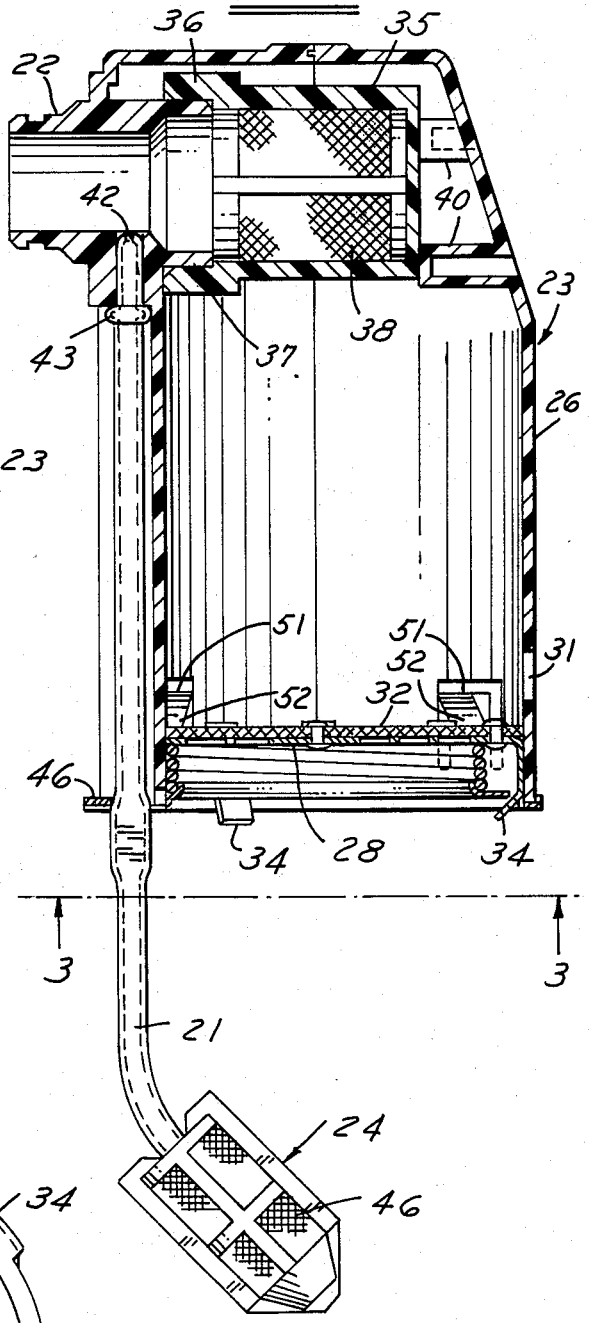
FIG. 2 is a vertical sectional view through a vapor drier canister assembly embodying the invention.

Referring to FIGS. 1 and 2, the accumulator-dehydrator assembly 15 comprises a housing 16 that is entirely enclosed to define an accumulator chamber 17 for the liquid refrigerant at the lower end. The housing 16 includes an axially aligned inlet and outlet tubes 18, 19. The accumulator-dehydrator assembly 15 further includes a vapor drier canister assembly 20 including a liquid refrigerant and oil tube 21 mounted externally of the assembly with the upper end of the tube extending into an outlet tube 22 of a canister 23 and the lower end of the tube 21 extending into a liquid filter 24 submerged in the liquid refrigerant.

The canister assembly 20 comprises a one-piece canister 23 made of plastic such as polypropylene. The canister 23 comprises two molded halves 23*a*, 23*b* joined by an integral hinge 39 and brought together, as presently described, to define a closed top wall 25, a closed side wall 26, an open bottom and the integral outlet 22 that projects into the outlet 19 of the accumulator housing and sealingly engages the outlet by use of an O-ring 27.

The canister assembly further includes a perforated plate 28 that is yieldingly urged upwardly by a spring 29 to press desiccant upwardly. The perforated plate 28 includes a felt pad 32 overlying and attached thereto as by rivets which functions to prevent particles of the desiccant D formed by vibrations from falling through the holes in the bottom plate 28, which would deplete the supply of desiccant. The felt pad 32 provides little restriction to the gas flow. The spring 29 is interposed between the perforated plate 28 and a retainer ring 30 crimped over the bottom of the side wall 26 at circumferentially spaced points. The canister is also formed with a desiccant filler opening 31 in the side wall.

Figure 3:
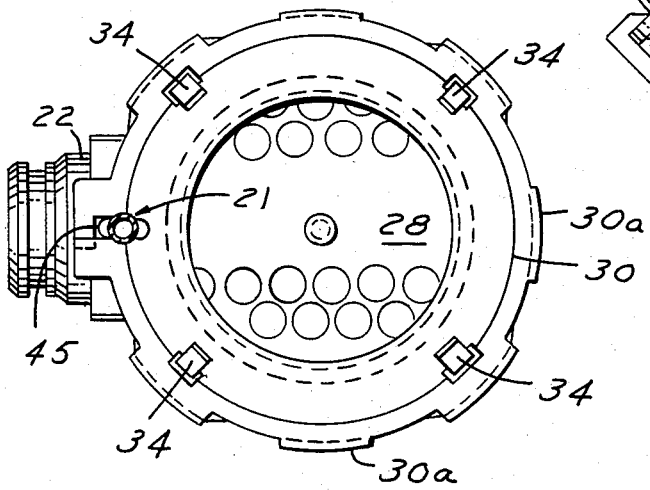
FIG. 3 is a fragmentary bottom plan view of the vapor drier canister assembly taken along the line 3—3 in FIG. 2.

Initaially, the canister 23 is inverted and the bottom plate 28 is held in position below the filler opening 31 (FIG. 2) so that the canister can be inverted, desiccant can be introduced through the filler opening 31 and the bottom plate 28 is thereafter released. Specifically, the bottom plate 28 includes a peripheral flange 33 having axial tabs 34 that extend through openings in the ring and are bent inwardly as in FIGS. 2 and 3 to retain the perforated bottom plate 28 below the filler opening 31. After the desiccant has been introduced, the tabs 34 are straightened permitting the spring 29 to urge the perforated plate 28 against the desiccant.

A filter 35 is provided with a peripheral flange 36 that telescopes over an annular wall 37 on the outlet 22. Gaseous refrigerant passes downwardly from the inlet, then upwardly through the desiccant and through the filter to the outlet. Filter 35 has mesh or foraminous walls 38 which function as a filter.

Figure 7:
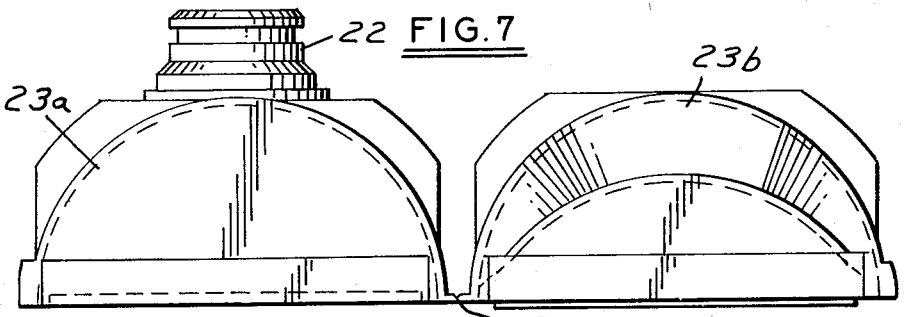
FIG. 7 is a top plan view of the portion shown in FIG. 5.
Figure 5:
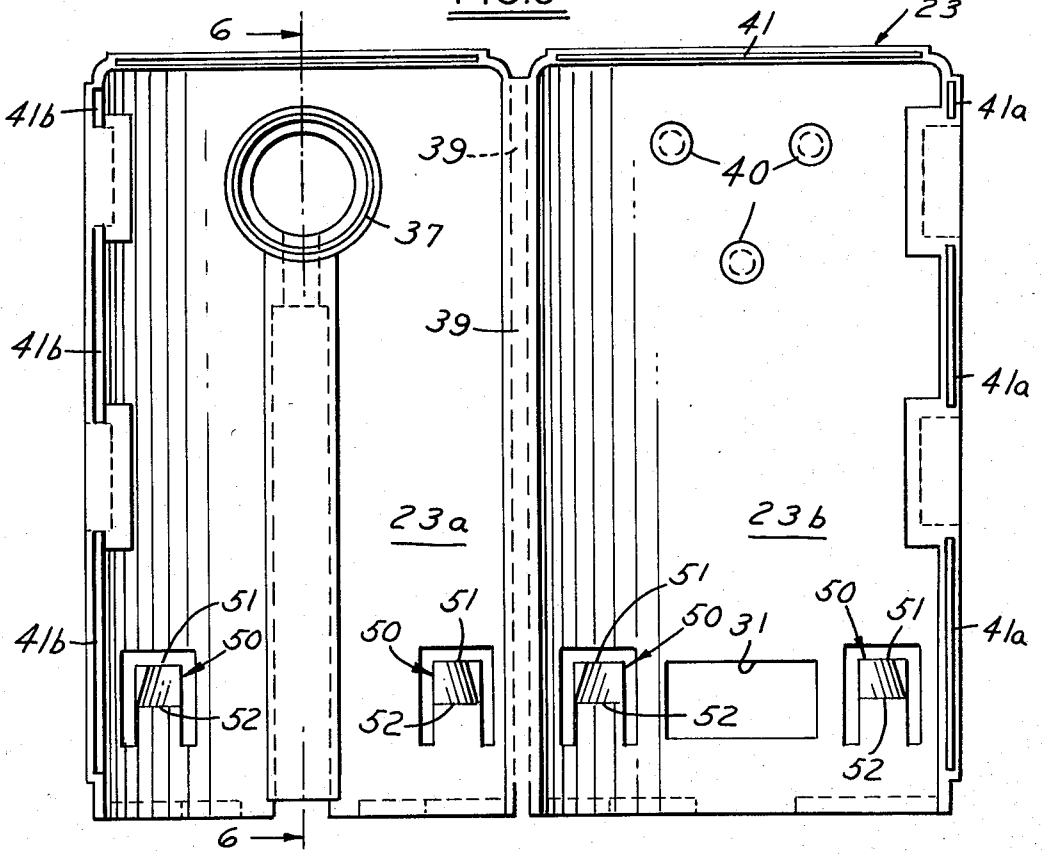
FIG. 5 is an elevational view of the canister prior to assembly.
Figure 6:
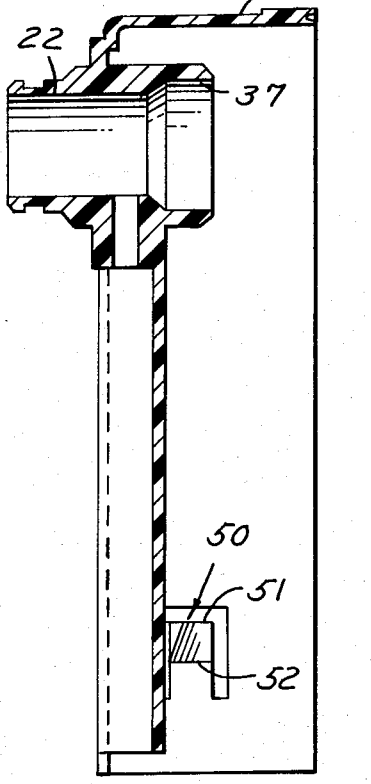
FIG. 6 is a fragmentary sectional view taken along the line 6—6 in FIG. 5.
Figure 8:
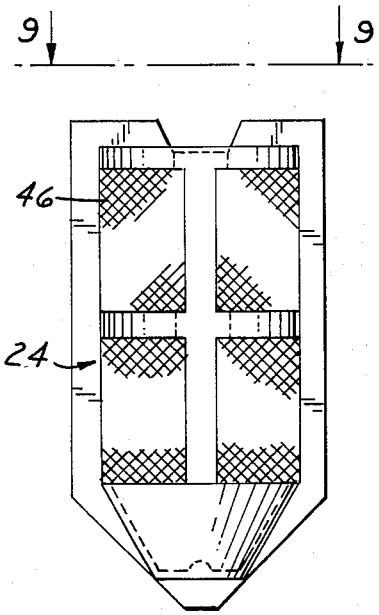
FIG. 8 is an elevational view of the liquid filter used in the system.
Figure 9:
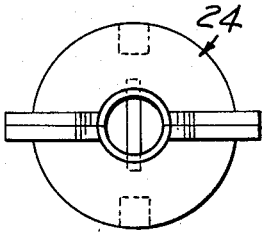
FIG. 9 is a top plan view taken along the line 9—9 in FIG. 8.
Figure 10:
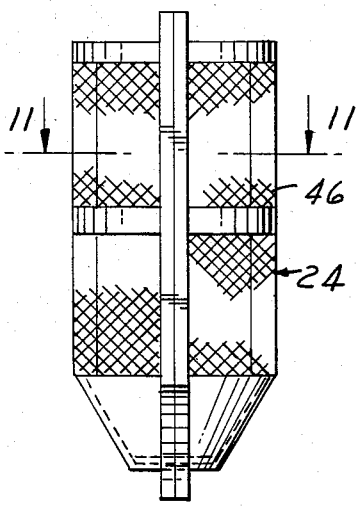
FIG. 10 is a side elevational view of the liquid filter shown in FIG. 8.
Figure 11:
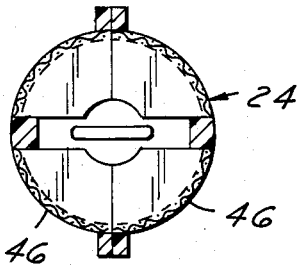
FIG. 11 is a sectional view taken along the line 11—11 in FIG. 10.

As shown in FIGS. 5–7, the canister 23 is molded as one piece comprising two halves 23*a*, 23*b* joined by an integral hinge 39. After molding, the filter 35 is positioned on the annular wall 37 and the two halves are brought together and joined ultrasonically to define the canister. The side wall includes a plurality of ribs or projections 40 extending inwardly into contact with filter 35 to hold the filter in position. Ribs 41*a* and grooves 41*b* may be provided to facilitate alignment and engagement of the two halves 23*a* and 23*b* prior to joining. Ribs 41*a* and grooves 41*b* provide a tongue and groove joint which has the primary purpose of insuring that there is no opening at the joined edge so that particles of desiccant and a secondary purpose of aligning the edges for joining.

After the canister halves are brought together and joined and the refrigerant and oil tube 21 is inserted into the outlet wall 22, the subassembly of retainer ring 30, bottom plate 28, pad 32 and spring 29, with tabs 34 extending through ring 30 and bent over, is placed on the open end of the canister 23 and attached thereto by crimping the ring 30 over the end of the canister as at 30*a*.

Figure 13:
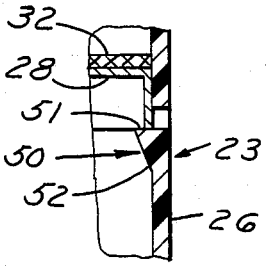
FIG. 13 is a fragmentary sectional view on an enlarged scale taken along the line 13—13 in FIG. 1.

Self-actuating integral stops 50 are provided on the side walls 23*a*, 23*b* of the canister for engaging the lower edge of the peripheral flange 33 of bottom plate 28 to insure that the plate 28 can not move downwardly on impact due to the weight of the desiccant overcoming the spring force to expose the filling opening momentarily allowing desiccant to escape. Each stop 50 is formed as a tab in the wall of the canister and is connected at its base to the wall. Each stop includes a transverse wall 51 and a ramp 52 inclined upwardly and radially inwardly so that as the flange 33 or bottom plate 28 is moved upwardly it will move along the ramp 52 pushing the stops 50 outwardly and snap over the wall 51 and the stops 50 will move radially inwardly under flange 33 to prevent axially outward movement of the bottom plate 28. (FIG. 13)

Figure 4:
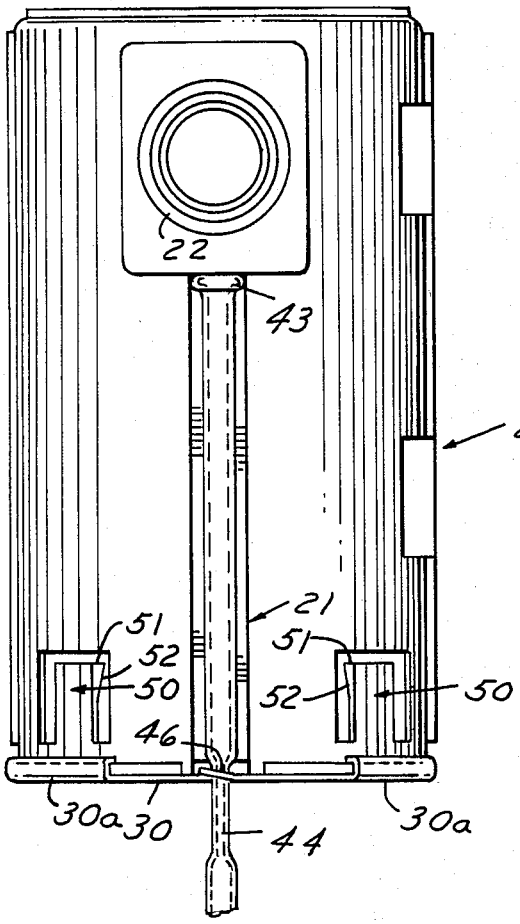
FIG. 4 is a fragmentary side elevational view of the vapor drier canister assembly.

Referring to FIGS. 2 and 4, the refrigerant and oil tube 21 is made of one-piece metal such as steel and includes an integral orifice 42 at the upper end, a deformed radially outwardly extending integral portion 43 spaced from the upper end which engages the outer wall of the outlet 22 and a flattened portion 44 intermediate the ends which engages a notch 45 in the ring 30 to hold the tube 21 in position externally of the canister. A tab 46 on plate 28 initially extends axially and is bent over to a transverse position to retain tube 21. The liquid filter 24 is press fitted on the lower end of the tube. The enlarged deformed portion 43 of the tube 21 adjacent the tube end serves two functions when it engages the outside wall of the tube 22. First it locates the orifice 42 in the proper position along the inner wall of the outlet to insure that the outlet flow of gaseous refrigerant causes sufficient venturi effect to draw oil and refrigerant droplets up the tube 21 and through the orifice 42. Secondly, it acts as a stop in conduction with the stop formed by the flattened portion 44 of the tube in the bottom member to hold the tube 21 in the proper vertical position.

Figure 12:
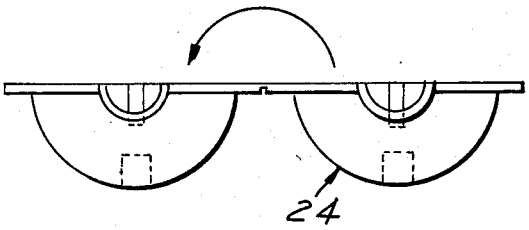
FIG. 12 is a top plan view of the liquid filter prior to assembly.

Referring to FIGS. 8–12, filter 24 comprises a hollow plastic body having foraminous or mesh walls 46 such that the liquid must flow through the filter to pass upwardly into the tube 21. As shown in FIG. 12, the liquid filter is molded in one piece to define two halves joined by an integral hinge such that when the halves are brought together and joined by fusion or bonding on the remaining edges, the hollow filter is defined.

It can thus be seen that there has been provided an accumulator-dehydrator assembly that is easy to manufacture and assemble, low in cost, and utilizes a minimum number of parts.

We claim:

1. An accumulator-dehydrator assembly for an air conditioning system comprising an accumulator housing defining an enclosed chamber including an inlet and an outlet in the upper end and a refrigerant and oil accumulator in the lower end, a vapor drier canister assembly comprising a one-piece plastic body defining a closed top wall, a closed side wall and an open bottom, said canister including an integral outlet projection extending into and sealingly engaging the outlet of said housing, a vapor filter associated with said integral outlet projection of said canister such that refrigerant flows through the filter before passing through the outlet, a perforated plate in the bottom of said canister for holding desiccant within said canister.

2. The accumulator-dehydrator assembly set forth in claim 1 including spring means yieldingly urging said perforated bottom plate upwardly, said canister having a desiccant filling opening in the side wall thereof, and interengaging means between said bottom plate and said canister for holding said bottom plate downwardly in a position such that desiccant can be introduced into said canister, said interengaging means being releasable to permit said bottom plate to be urged upwardly beyond the filling opening after the desiccant is introduced into the canister.

3. The accumulator-dehydrator assembly set forth in claim 2 including stop means on said canister operable after said bottom plate is urged upwardly to prevent said bottom plate from moving downwardly below the top of the filling opening.

4. The accumulator-dehydrator assembly set forth in claim 3 wherein said stop means comprises stop members integrally molded on said side wall.

5. The accumulator-dehydrator assembly set forth in claim 4 wherein each said stop member includes a transverse wall and a ramp extending axially and radially inwardly for engaging the periphery of said bottom plate.

6. The accumulator-dehydrator assembly set forth in claim 2 wherein said releasing means is actuatable from the exterior of said canister.

7. The accumulator-dehydrator assembly set forth in claim 6 wherein said releasing means comprises a plurality of tabs on said bottom plate, a member on the bottom of said canister, said tabs extending through openings in said member and being bent to retain the first bottom plate in a position such that the filler opening is exposed to permit introduction of desiccant into the canister.

8. The accumulator-dehydrator assembly set forth in claim 1 wherein said canister is formed as a one-piece molded part comprising two halves joined by an integral hinge, said halves being brought together and bonded to define said canister.

9. The accumulator-dehydrator assembly set forth in claim 8 wherein said halves are bonded by ultrasonic fusion.

10. The accumulator-dehydrator assembly set forth in claim 1 including a refrigerant and oil tube having an upper end and a lower end, the lower end extending to the bottom of the chamber of the accumulator housing, said tube being mounted externally of said canister and having its upper end extending into the outlet of said canister, and filter means associated with the lower end of the tube.

11. The accumulator-dehydrator assembly set forth in claim 10 wherein said oil and refrigerant tube comprises a one-piece tube having an orifice in the upper end thereof.

12. The accumulator-dehydrator assembly set forth in claim 11 wherein said tube includes a flattened portion intermediate its ends, said housing having a bottom member which includes an opening for engaging said flattened portion and holding said tube in position.

13. The accumulator-dehydrator assembly set forth in claim 12 including an enlarged deformed portion adjacent the upper end of the tube for engaging the exterior of the outlet of the canister.

14. The accumulator-dehydrator assembly set forth in claim 10 wherein said filter means comprises a one-piece molded filter consisting of two molded halves joined by an integral hinge and folded to bring the two halves together and thereby define a filter housing, said housing having foraminous walls, said refrigerant and oil tube extending axially into said housing and being press fitted therein.

15. The accumulator-dehydrator assembly set forth in claim 1 wherein said canister body includes integral means extending from a side wall thereof and engaging the vapor filter.

16. The accumulator-dehydrator assembly set forth in claim 1 wherein said bottom plate is telescoped within the lower end of said canister, said canister having a canister filling opening in the side wall thereof, spring means normally urging said bottom plate upwardly past said opening whereby said canister can be filled with desiccant by holding said bottom plate downwardly in a position such that desiccant can be introduced into said canister through said opening.

17. The accumulator-dehydrator assembly set forth in claim 16 including interengaging means between said bottom plate and said canister for holding said bottom plate downwardly in a position such that desiccant can be introduced into said canister, said interengaging means being releasable to permit said bottom plate to be urged upwardly after the desiccant is introduced into the canister.

18. The accumulator-dehydrator assembly set forth in claim 1 including a member, means for attaching said member to said open bottom of said canister and spring means interposed between said member and said bottom plate yieldingly urging said bottom plate axially inwardly.

19. The accumulator-dehydrator assembly set forth in claim 18 wherein said means attaching said member comprises integral portions of said member crimped on said canister.

20. An accumulator-dehydrator assembly for an air conditioning system comprising an accumulator housing defining an enclosed chamber including an inlet and an outlet in the upper end and a refrigerant and oil accumulator in the lower end, a vapor drier canister assembly comprising a body defining a closed top wall, a closed side wall and an open bottom, said canister including an integral outlet projection extending into and sealingly engaging the outlet of said housing, a vapor filter associated with said integral outlet projection of said canister such that refrigerant flows through the filter before passing through the outlet, a perforated bottom plate in the bottom of said canister for holding desiccant within said canister, said canister having a desiccant filling opening in the side wall thereof, and said perforated plate being telescoped within the lower end of said canister, spring means normally urging said bottom plate upwardly past said opening whereby said canister can be filled with desiccant by holding said bottom plate downwardly in a position such that desiccant can be introduced into said canister through said opening.

21. The accumulator-dehydrator assembly set forth in claim 20 including stop means on said canister operable after said bottom plate is urged upwardly to prevent said bottom plate from moving downwardly below the top of the filling opening.

22. The accumulator-dehydrator assembly set forth in claim 21 wherein said stop means comprises stop members integrally molded on said side wall.

23. The accumulator-dehydrator assembly set forth in claim 22 wherein each said stop member includes a transverse wall and a ramp extending axially and radially inwardly for engaging the periphery of said bottom plate.

24. The accumulator-dehydrator assembly set forth in claim 20 including interengaging means between said bottom plate and said canister for holding said bottom plate downwardly in a position such that when the canister is inverted, desiccant can be introduced into said canister, said interengaging means being releasable to permit said bottom plate to be urged upwardly after the desiccant is introduced into the canister.

25. The accumulator-dehydrator assembly set forth in claim 24 wherein said releasing means is actuatable from the exterior of said canister.

26. The accumulator-dehydrator assembly set forth in claim 25 wherein said releasing means comprises a plurality of tabs on said bottom plate, a member on the bottom of said canister, said tabs extending through openings in said member and being bent to retain the first bottom plate in a position such that the filter opening is exposed to permit introduction of desiccant into the canister.

27. For use in an accumulator-dehydrator assembly for an air conditioning system, having an accumulator housing defining an enclosed chamber including an inlet and an outlet in the upper end and a refrigerant and oil accumulator in the lower end, a vapor drier canister assembly comprising a one-piece plastic body defining a closed top wall, a closed side wall and an open bottom, said canister including an integral outlet projection adapted to extend into and sealingly engage the outlet of the housing, a vapor filter associated with said integral outlet projection of said canister such that refrigerant flows through the filter before passing through the outlet, a perforated plate in the bottom of said canister for holding desiccant within said canister.

28. The vapor drier canister assembly set forth in claim 27 including spring means yieldingly urging said perforated bottom plate upwardly, said canister having a desiccant filling opening in the side wall thereof, and interengaging means between said bottom plate and said canister for holding said bottom plate downwardly in a position such that desiccant can be introduced into said canister, said interengaging means being releasable to permit said bottom plate to be urged upwardly after the desiccant is introduced into the canister.

29. The vapor drier canister assembly set forth in claim 28 wherein said releasing means is actuatable from the exterior of said canister.

30. The vapor drier canister assembly set forth in claim 29 including stop means on said canister operable after said bottom plate is urged upwardly to prevent said bottom plate from moving adjacent the filling opening.

31. The vapor drier canister assembly set forth in claim 30 wherein said stop means comprises stop members integrally molded on said side wall.

32. The vapor drier canister assembly set forth in claim 31 wherein each said stop member includes a transverse wall and a ramp extending axially and radially inwardly for engaging the periphery of said bottom plate.

33. The vapor drier canister assembly set forth in claim 28 wherein said releasing means comprises a plurality of tabs on said bottom plate, a member on the bottom of said canister, said tabs extending through openings in said member and being bent to retain the first bottom plate in a position such that the filler opening is exposed to permit introduction of desiccant into the canister.

34. The vapor drier canister assembly set forth in claim 27 wherein said canister is formed as a one-piece molded part comprising two halves joined by an integral hinge, said halves being brought together and bonded to define said canister.

35. The vapor drier canister assembly set forth in claim 34 wherein said halves are bonded by ultrasonic fusion.

36. The vapor drier canister assembly set forth in claim 35 wherein said oil and refrigerant tube comprises a one-piece tube having an orifice in the upper end thereof.

37. The vapor drier canister assembly set forth in claim 27 including a refrigerant and oil tube having an upper end and a lower end, the lower end extending to the bottom of the chamber of the accumulator housing, said tube being mounted externally of said canister and having its upper end extending into the outlet of said canister, and filter means associated with the lower end of the tube.

38. The vapor drier canister assembly set forth in claim 37 wherein said liquid filter comprises a one-piece molded filter consisting of two molded halves joined by an integral hinge and folded to bring the two halves together and thereby define a filter housing, said housing having foraminous walls, said refrigerant and oil tube extending axially into said housing and being press fitted therein.

39. The vapor drier canister assembly set forth in claim 27 wherein said tube includes a flattened portion intermediate its ends, said housing having a bottom member which includes an opening for engaging said flattened portion and holding said tube in position.

40. The vapor drier canister assembly set forth in claim 39 including an enlarged deformed portion adjacent the upper end of the tube for engaging the exterior of the outlet of the canister.

41. The vapor drier canister assembly set forth in claim 27 wherein said canister body includes integral means extending from a side wall thereof and engaging the vapor filter.

42. The vapor drier canister assembly set forth in claim 27 wherein said bottom plate is telescoped within the lower end of said canister, said canister having a canister filling opening in the side wall thereof, spring means normally urging said bottom plate upwardly past said opening whereby said canister can be filled with desiccant by holding said bottom plate downwardly in a position such that desiccant can be introduced into said canister through said opening.

43. The vapor drier canister assembly set forth in claim 42 including interengaging means between said bottom plate and said canister for holding said bottom plate downwardly in a position such that desiccant can be introduced into said canister, said interengaging means being releasable to permit said bottom plate to be urged upwardly after the desiccant is introduced into the canister.

44. The vapor drier canister assembly set forth in claim 42 including stop means on said canister operable after said bottom plate is urged upwardly to prevent said bottom plate from moving downwardly below the top of the filling opening.

45. The vapor drier assembly set forth in claim 44 wherein said stop means comprises stop members integrally molded on said side wall.

46. The vapor drier assembly set forth in claim 45 wherein each said stop member includes a transverse wall and a ramp extending axially and radially inwardly for engaging the periphery of said bottom plate.

47. The vapor drier canister assembly set forth in claim 27 including a member, means for attaching said member to said open bottom of said canister and spring means interposed between said member and said bottom plate yieldingly urging said bottom plate axially inwardly.

48. The vapor drier assembly set forth in claim 47 wherein said means attaching said member comprises integral portions of said member crimped on said canister.

49. For use in an accumulator-dehydrator assembly for an air conditioning system comprising an accumulator housing defining an enclosed chamber including an inlet and an outlet in the upper end and a refrigerant and oil accumulator in the lower end, a vapor drier canister assembly comprising a body defining a closed top wall, a closed side wall and an open bottom, said canister including an integral outlet projection adapted to extend into and sealingly engage the outlet of the housing, a vapor filter associated with said integral outlet projection of said canister such that refrigerant flows through the filter before passing through the outlet, a perforated bottom plate in the bottom of said canister for holding desiccant within said canister, said canister having a desiccant filling opening in the side wall thereof, spring means yieldingly urging said perforated bottom plate upwardly past said opening whereby said canister can be filled with desiccant by holding said bottom plate downwardly in a position such that the desiccant can be introduced into said canister through said opening.

50. The vapor-drier canister assembly set forth in claim 49 including interengaging means between said bottom plate and said canister for holding said bottom plate downwardly in a position such that when the canister is inverted, desiccant can be introduced into said canister, said interengaging means being releasable to permit said bottom plate to be urged upwardly after the desiccant is introduced into the canister.

51. The vapor drier canister assembly set forth in claim 49 wherein said releasing means is actuatable from the exterior of said canister.

52. The vapor drier canister assembly set forth in claim 51 wherein said releasing means comprises a plurality of tabs on said bottom plate, a member on the bottom of said canister, said tabs extending through openings in said member and being bent to retain the first bottom plate in a position such that the filler opening is exposed to permit introduction of desiccant into the canister.

53. The vapor drier canister assembly set forth in claim 49 including stop means on said canister operable after said bottom plate is urged upwardly to prevent said bottom plate from moving downwardly below the top of the filling opening.

54. The vapor drier canister assembly set forth in claim 53 wherein said stop means comprises stop members integrally molded on said side wall.

55. The vapor drier canister assembly set forth in claim 54 wherein each said stop member includes a transverse wall and a ramp extending axially and radially inwardly for engaging the periphery of said bottom plate.

56. An accumulator-dehydrator assembly for an air conditioning system comprising an accumulator housing defining an enclosed chamber including an inlet and an outlet in the upper end and a refrigerant and oil accumulator in the lower end, a vapor drier canister assembly comprising a body defining a closed top wall, a closed side wall and an open bottom, said canister including an integral outlet projection extending into and sealingly engaging the outlet of said housing, a vapor filter associated with said integral outlet projection of said canister such that refrigerant flows through the filter before passing through the outlet, a refrigerant and oil tube having an upper end and a lower end, the lower end extending to the bottom of the chamber of the accumulator housing, said tube being mounted externally of said canister and having its upper end extending into the outlet of said canister, and filter means associated with the lower end of the tube.

57. The accumulator-dehydrator assembly set forth in claim 56 wherein said oil and refrigerant tube comprises a one-piece tube having an orifice in the upper end thereof.

58. The accumulator-dehydrator assembly set forth in claim 57 wherein said tube includes a flattened portion intermediate its ends, said housing having a bottom member which includes an opening for engaging said flattened portion and holding said tube in position.

59. The accumulator-dehydrator assembly set forth in claim 58 including an enlarged deformed portion adjacent the upper end of the tube for engaging the exterior of the outlet of the canister.

60. An accumulator-dehydrator assembly for an air conditioning system comprising an accumulator housing defining an enclosed chamber including an inlet and an outlet in the upper end and a refrigerant and oil accumulator in the lower end, a vapor drier canister assembly comprising a one-piece plastic body defining a closed top wall, a closed side wall and an open bottom, said canister including an integral outlet projection extending into and sealingly engaging the outlet of said housing, a vapor filter associated with said integral outlet projection of said canister such that refrigerant flows through the filter before passing through the outlet, a perforated plate in the bottom of said canister for holding desiccant within said canister, spring means yieldingly urging said perforated bottom plate upwardly, stop means on said canister operable after said bottom plate is urged upwardly to prevent said bottom plate from moving downwardly below the top of the filling opening.

61. The accumulator-dehydrator assembly set forth in claim 60 wherein said stop means comprises stop members integrally molded on said side wall.

62. The accumulator-dehydrator assembly set forth in claim 61 wherein each said stop member includes a transverse wall and a ramp extending axially and radially inwardly for engaging the periphery of said bottom plate.

* * * * *